US005209784A

United States Patent [19]

Bellman

[11] Patent Number: 5,209,784

[45] Date of Patent: May 11, 1993

[54] METHOD AND APPARATUS FOR JEWELRY AND SMALL PARTS CLEANING

[76] Inventor: David H. Bellman, 1650 Elm St., Manchester, N.H. 03101

[21] Appl. No.: 830,767

[22] Filed: Jan. 30, 1992

Related U.S. Application Data

[62] Division of Ser. No. 572,689, Aug. 24, 1990, abandoned.

[51] Int. Cl.[5] ..... B08B 3/02

[52] U.S. Cl. ..... 134/25.4; 134/42; 134/201; 134/198; 134/135; 220/488

[58] Field of Search ..... 134/200, 201, 198, 199, 134/182, 135, 84, 2, 25.1, 25.4, 25.2, 42; 220/485, 487, 486, 488

[56] References Cited

U.S. PATENT DOCUMENTS

| | | | |
|---|---|---|---|
| 1,899,495 | 2/1933 | Celaya | 134/200 |
| 2,632,452 | 3/1953 | Spitzer | 134/200 X |
| 2,666,440 | 1/1954 | Collins | 134/182 X |
| 2,669,243 | 2/1954 | Reynolds | 134/200 X |
| 2,960,991 | 11/1960 | Bland | 134/182 |
| 3,009,468 | 11/1961 | Erberle | 134/199 X |
| 3,025,864 | 3/1962 | Ensign | 220/488 X |
| 3,961,984 | 6/1976 | Torrensen | 134/200 X |
| 4,748,993 | 6/1988 | Llewellyn | 134/201 X |
| 4,941,490 | 7/1990 | Gross | 134/102 |
| 4,957,130 | 9/1990 | Lee | 134/200 |

FOREIGN PATENT DOCUMENTS

| | | | |
|---|---|---|---|
| 2224926 | 5/1990 | United Kingdom | 134/135 |

*Primary Examiner*—Frankie L. Stinson

*Attorney, Agent, or Firm*—George W. Dishong

[57] ABSTRACT

A device/apparatus and a method of cleaning small parts such as for example, jewelry pieces. The jewelry pieces which are to be cleaned are securely positioned or positionable within the main cavity of the apparatus and the walls of the apparatus are made of material and have a form which will permit the cleaning solution, preferably water with a detergent added, to pass through the walls and to impinge onto substantially all of the surfaces of the pieces to be cleaned and impinge with sufficient velocity and in sufficient volume, when used within any of the well known types or brands of automatic dishwashers, so as to be effective in the cleaning of the pieces. The apparatus comprises a main cavity for containing jewelry pieces and the walls defining the cavity are adapted to permit the turbulent and high velocity cleaning fluid of an operating automatic dishwasher to impinge onto the jewelry pieces contained within the main cavity. There is an access or opening to the main cavity for inserting the jewelry pieces into the main cavity. A cover for the access is provided which is adapted to permit the turbulent and high velocity cleaning fluid to impinge onto the jewelry pieces and the small parts contained within the main cavity. The cover is securely attachable to the walls of the main cavity. There is also provided various devices, such as hooks, posts, and compartments into which and onto which various types and sizes of jewelry pieces may be securely and effectively placed and which permits the turbulent and high velocity cleaning fluid to impinge onto each of the jewelry pieces and small parts contained within the main cavity.

6 Claims, 2 Drawing Sheets

METHOD AND APPARATUS FOR JEWELRY AND SMALL PARTS CLEANING

This application is a division of application Ser. No. 572,689, filed Aug. 24, 1990 now abandoned.

BACKGROUND OF THE INVENTION

1. Field of the Invention

This invention most generally relates to a method of and a device/apparatus for use in cleaning small parts such as for example, jewelry pieces. The jewelry pieces which are to be cleaned are securely positioned or positionable within the main cavity of the apparatus and the walls of the apparatus are made of material and have a form which will permit the cleaning solution, preferably water with a detergent added, to pass through the walls and to impinge onto substantially all of the surfaces of the pieces to be cleaned and impinge with sufficient velocity and in sufficient volume, when used within any of the well known types or brands of automatic dishwashers, so as to be effective in the cleaning of the pieces. More particularly, the invention is directed to an apparatus comprising a main cavity for containing jewelry pieces and the walls defining the cavity are adapted to permit the turbulent and high velocity cleaning fluid of an operating automatic dishwasher to impinge onto the jewelry pieces contained within the main cavity. There is also provided various devices, such as hooks, posts, and compartments into which and onto which various types and sizes of jewelry pieces may be securely and effectively placed and which permits the turbulent and high velocity cleaning fluid to impinge onto each of the jewelry pieces and small parts contained within the main cavity.

2. Description of the Prior Art

Presently there is nothing available that permits the safe and effective self-cleaning or home cleaning of jewelry pieces. There has been little inventive activity in the field of containers, devices or methods for cleaning jewelry.

Today jewelry is a multi-billion dollar industry and growing as the Americans, Japanese and the Europeans continue to spend a fair amount of their disposable income on jewelry related items. A large portion of the jewelry purchased is 14K and 18K jewelry in the form of bracelets, necklaces and earrings, but the bulk purchased resides in precious and semi-precious gem stone jewelry. The most popular of course is the diamond engagement ring, a ritual created by the diamond producers themselves back in the late 1800's.

Over the past 125 years or so people have been giving more than just engagement rings. In fact, jewelry has been worn for thousands of years and today almost every person wears some form of jewelry. The question has always been "What is the best way and the safest way to clean my jewelry/" and most people are completely uneducated as to what will and will not harm a piece of jewelry (not that a booklet detailing the methods and the procedures for using the invention will likely accompany each device) so most either don't bother or a few will make a trip to a jeweler and have a professional do it. The present invention will help educate the consumer as to what can be cleaned as well as provide a device in which it can be done safely and thoroughly in their own home as often as is desired without any undue work or effort on their part.

Today the best product available to the public is a jar of 90% water and 10% cleaning solution in which a basket and a miniature brush are provided. This cleaner has been tested by the inventor of the instant invention and found that if the item is soaked for hours and brushed vigorously perhaps 30% of the dirt and oil on the piece may be removed. The present invention (the INSTA-SHINE jewelry cleaner) uses the same principles used by professional jewelers, hot water and pressure combined with a cleaning solution.

An automatic dishwasher of the ordinary type found in most homes provides the hot water, water pressure and cleaning solution all in one appliance. Not only does this cleaner, when used with the apparatus of the present invention, clean as well as a professional, but it is a definite advantage and a convenience to being able to place jewelry into an apparatus or container and place it into a dishwasher go to bed and take out sparkling clean jewelry in the morning.

Tests have shown that even a piece of jewelry that has not been cleaned in at least a year, when cleaned by the method and apparatus disclosed herein, 80% to 85% of the oil and dirt will be removed in one cleaning. A weekly or monthly cleaning program is recommended. Such a program is not only effective but it is also safe.

After reviewing patents which were developed in a search, no structure or method for cleaning jewelry similar to the present invention was found nor was one suggested. None of the prior art known to the inventor hereof satisfies the need for effectively cleaning jewelry or other small parts in an effective and high quality, simple and economically feasible way. No one has considered the advantages of cleaning jewelry using a container such as is disclosed herein and used within an ordinary household automatic dishwasher. The dishwasher provides high velocity and high pressure cleaning solution which impinges onto the pieces contained within the container.

The U.S. Patents reviewed were U.S. Pat. Nos. 3,167,079 to Weil, 3,894,551 to Stohlman, 3,960,290 to Yake et al; 4,498,594 to Elder; 4,830,200 to Zambano et al; and 4,836,392 to Constantino.

SUMMARY OF THE INVENTION

The present invention in it's most simple form or embodiment is directed to a special container or apparatus and the use of the container, in a space wherein there is high pressure and volume of cleaning solution, to clean jewelry or small parts. The special container or apparatus securely and safely positions and holds jewelry pieces within it. The container or apparatus, when placed within a machine such as an automatic dishwasher or other device which provides high velocity, high pressure cleaning solution, is designed to allow the flow-through of high velocity and high volume cleaning solution such as water with a detergent added thereto.

A primary object of the invention is to provide a jewelry and small parts cleaning apparatus adapted to removably and nondamagingly contain jewelry pieces and/or small parts to be cleaned when the apparatus is placed within a machine which provides a turbulent and high velocity cleaning fluid. The apparatus comprises; a wall means defining a main cavity for containing jewelry pieces therein and the wall means is adapted to permit the turbulent and high velocity cleaning fluid to pass therethrough and to impinge onto the jewelry pieces and the small parts contained within the main cavity. The main cavity has edges which define an access or opening through which jewelry pieces are placed into the main cavity. There is also included a means for covering the access which covering is adapted to permit the turbulent and high velocity cleaning fluid to pass therethrough and to impinge onto the jewelry pieces and the small parts contained within said main cavity. There is also provided a means for securely attaching the covering to the walls which define the main cavity. Additionally there is provided a means for holding in a substantially fixed location and position each of the jewelry pieces within the main cavity in a manner which permits the turbulent and high velocity cleaning fluid to impinge onto the jewelry pieces and the small parts contained within the main cavity.

A more particular object of the present invention is to provide a jewelry and small parts cleaning apparatus wherein the walls defining the main cavity and the covering of the access are made from at least one of the materials selected from the group consisting of nylon mesh, metallic mesh, plastic mesh, fiberglass mesh, fabric mesh, woven wood and plastic having a plurality of apertures or holes therethrough.

A still more particular object of the present invention is to provide a jewelry and small parts cleaning apparatus further comprising a plurality of attaching devices, such as hooks, posts, onto which various types and sizes of jewelry pieces may be securely and effectively placed and at least one compartment into which various types and sizes of jewelry pieces may be securely and effectively placed. The attaching devices and the at least one compartment are all adapted to permit the turbulent and high velocity cleaning fluid to impinge onto each of the jewelry pieces and small parts contained within the main cavity.

The machine which provides a turbulent and high velocity cleaning fluid is most preferably an automatic dishwasher and the cleaning fluid is water having an appropriate cleaning detergent contained therein.

A further object of the present invention is to provide a method for cleaning jewelry and small parts using the above described apparatus which is adapted to removably and nondamagingly contain jewelry pieces and small parts to be cleaned and adapted to permit a turbulent and high velocity cleaning fluid to impinge onto said jewelry pieces and said small parts contained within a main cavity of said apparatus. The method comprises the steps of: placing the jewelry pieces into the main cavity; holding in a substantially fixed location and position using hooks and posts each of the jewelry pieces within the main cavity in a manner which permits the turbulent and high velocity cleaning fluid to impinge onto the jewelry pieces and the small parts contained within the main cavity; covering the main cavity of the apparatus using a covering means adapted to permit the turbulent and high velocity cleaning fluid to impinge onto the jewelry pieces and the small parts contained within a main cavity of the apparatus; attaching the cover to the apparatus; and placing the apparatus within a machine which provides the turbulent and high velocity cleaning fluid and permitting the turbulent and high velocity cleaning fluid to impinge onto the jewelry pieces for a predetermined period of time. The machine is most preferably an automatic dishwasher and the cleaning fluid is water having an appropriate cleaning detergent contained therein.

These and further objects of the present invention will become apparent to those skilled in the art to which this invention pertains and after a study of the present disclosure of the invention.

DESCRIPTION OF THE PREFERRED EMBODIMENTS

Figure 1:
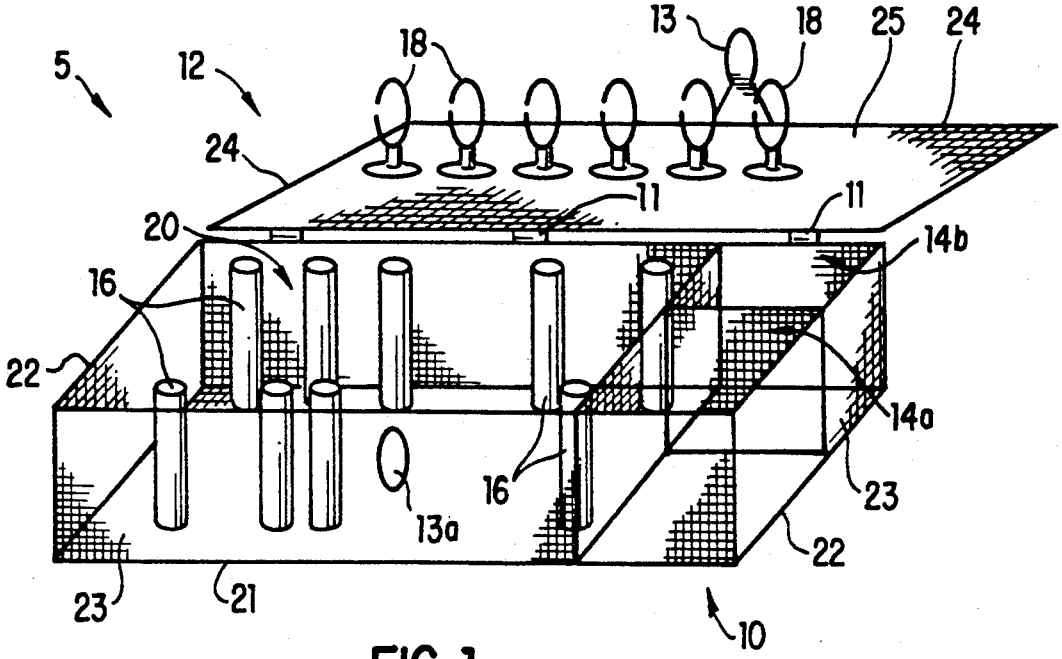
FIG. 1 is a perspective illustration of the jewelry and small parts cleaning apparatus with the cover in the open position illustrating the posts around which chains, necklaces, bracelets, anklets and the like, of various lengths, may be positioned and hooks upon which rings and the like may be attached and two (2) compartments for holding items to be cleaned which are not otherwise attachable.

The following is a description of the preferred embodiment of the invention. It is clear that there may be variations in the size and the shape of the apparatus. However, the main features of the device/apparatus and the method of cleaning jewelry pieces or other small parts are such that the jewelry pieces or other small parts which are to be cleaned must be securely positioned or positionable within the main cavity of the apparatus and the walls of the apparatus must be made of material and have a form which will permit the cleaning solution, preferably water with a detergent added, to impinge onto substantially all of the surfaces of the pieces to be cleaned and impinge with sufficient velocity and in sufficient volume, when used within any of the well known types or brands of automatic dishwashers so as to be effective in the cleaning of the pieces. It is unobvious and surprising that jewelry pieces can be very effectively and safely cleaned within an automatic dishwasher when the pieces are securely affixed and positioned within a container that permits or allows the cleaning water from the automatic dishwasher to impinge or strike the surfaces of the pieces and yet keep the pieces safely positioned within the container or apparatus.

In order to describe the invention most clearly and simply, the apparatus 5 will be described as being substantially a rectangular shaped container 10 or main cavity 20 having a lid 12 with a fastener 13 and the lid hinged 11, by known hinging methods, to the container 10. The container 10 and the lid 12 is described as being walls 23 and a bottom 21 made from a mesh material sufficiently fine so as to safely contain within the main cavity the smallest of the jewelry pieces which are intended to be cleaned by use of the instant method and container. It is clear to those of ordinary skill that the container, including the covering, may be made of plastic, metallic or fabric mesh placed on a wire, plastic or even a wooden frame assembly. Parts to be cleaned which are smaller than the mesh holes, may be place into a finer mesh container or "bag" and placed with the apparatus. It is also clear that the apparatus of this invention may be made from the containers of the type known as "TUPPERWARE" ® having the "snap-on" lid and designed to have a plurality of openings placed within the walls and the lid, of appropriate size and in sufficient quantity to allow adequate flow-through of the cleaning solution may be used.

Figure 2:
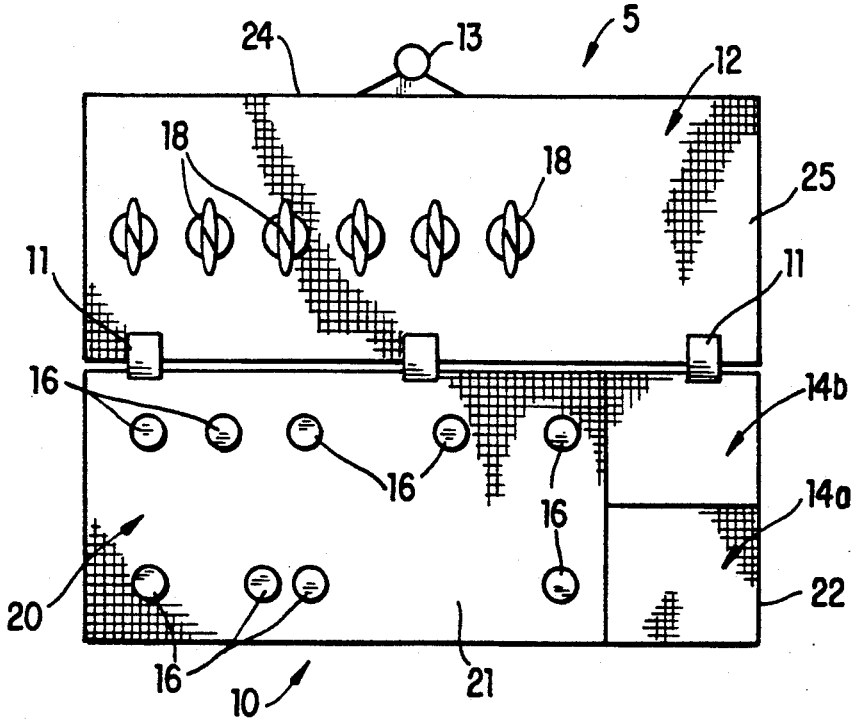
FIG. 2. is a top view of the jewelry and small parts cleaning apparatus again with the cover in the open position showing the access to the main cavity and to the two (2) compartments.

Reference is now made to FIGS. 1 and 2 which depicts an embodiment of the apparatus 5 of the invention. The walls 23 and the bottom 21 of the container 10 which defines the main cavity 20 are made from a mesh made of materials such as fiberglass, metallic, plastic, fabric or even wood. Where the mesh material is nonstructural, such as fiberglass or fabric, a main cavity frame 22 is used in order to support the mesh material. Likewise, the covering or lid 12 is made of a frame 24 to which or on which the covering of mesh material 25 is attached. There is an illustration or a representation of hooks 18 onto which rings and the like may be attached. These hooks or clips 18 are preferably attached to the cover 12 but may be attached elsewhere within the main cavity 20 of apparatus 5 such as along one or another of the walls 23. The cover fastening means 13 and the female portion of the fastener 13*a* and the hinge means 11 are shown without particular detail as these components may take a variety of forms depending upon the type of mesh material that is used and the type of frame 22 and 24 that is used to make the apparatus 5.

In FIGS. 1 and 2 there are shown two small parts compartments 14*a* and 14*b* into which pieces which are not amenable to mounting on either the hooks 18 or the plurality of posts 16 are placed. These compartments 14*a* and 14*b* are created by providing divider walls within the main cavity 20. The posts 16 are a part of or are attached to the bottom 21 of container 10. The posts 16 are long enough so that when lid 12 is in the closed position there is little if any clearance between the top of the posts 16 and mesh covering 25. The purpose of this construction is to keep chains and neclaces of various lengths and which may be positioned within cavity 20 from dislodging while being subjected to the high velocity/high pressure cleaning solution. The posts 16 may be positioned relative to each other to accept chains and/or necklaces having lengths of, for example seven (7) inch, eight (8) inch, eleven (11) inch, sixteen (16) inch, eighteen (18) inch, twenty (20) inch, twenty four (24) inch or any other desireable lengths. Obviously the posts 16 may have the same or different diameters and they may or may not be cylindrically configured.

Figure 3:
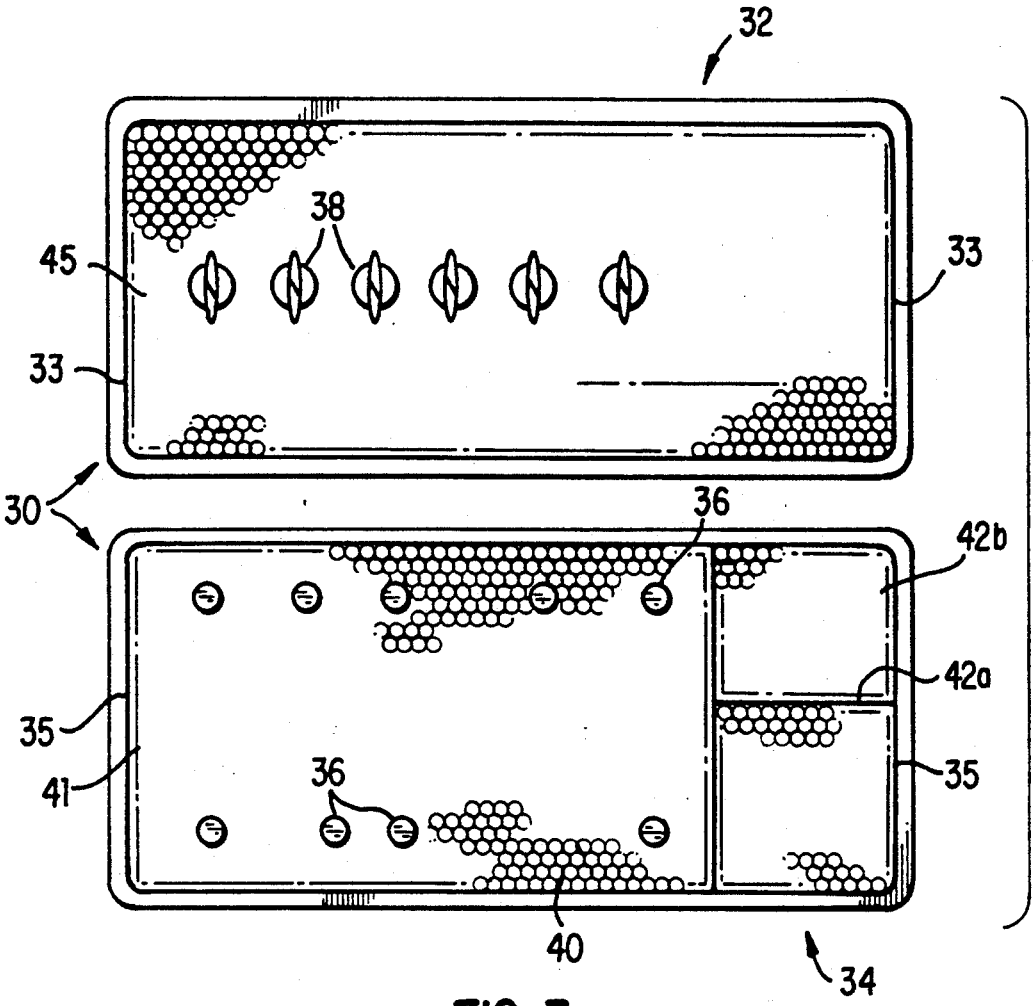
FIG. 3. illustrates another embodiment of the apparatus wherein the apparatus is similar in form to "TUPPERWARE" types of containers and wherein the walls and the lid are perforated with a plurality of holes showing the lid removed from the container portion and above the container.
Figure 4:
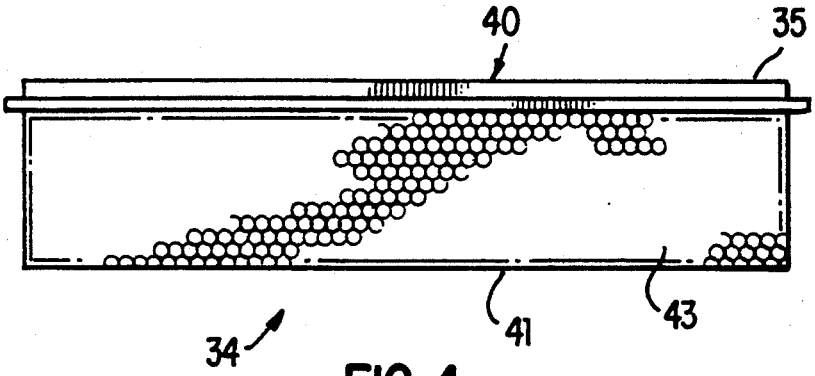
FIG. 4. is a side view sketch illustrating the apparatus of the invention in the form of a "TUPPERWARE" type of container.

In FIGS. 3 and 4 the apparatus 30 is in the form of a plastic container 34 having perforated walls 43 and the lid or cover 32 also having a plurality of holes 45. Mounted on the lid 32 are hooks or clips 38 designed to hold rings, loop earrings and the like. The groove 33 and the lip 35 are designed so that when the lid 32 is assembled onto the container 34 the groove 33 and the lip 35 securely engage so that the the main cavity 40 and compartments 42*a* and 42*b* will safely contain the jewelry pieces which are being cleaned. The posts 36 are attached to bottom 41 and function in the same manner as the posts 16 of FIGS. 1 and 2.

In the process of cleaning jewelry pieces, the pieces are approriately and securely placed within the main cavity 20 or 40. Rings are attached to hooks or clips 18 or 38, necklaces, anklets, bracelets and chains are positioned onto or around posts 16 or 36, and other pieces not mountable onto either posts 16 or 36 or clips 18 or 38 may be placed into either one or both compartments 14*a* and 14*b* or 42*a* or 42*b*. If there are stones, earrings or pieces which are so small that they may pass through the mesh walls 23 or 43 or the mesh cover 25 or the plastic lid 45 these may be placed within a bag of finer mesh and the bag then placed within either the main cavity 20 or one of the compartments 14*a* or 14*b* which are within main cavity 20. The cover 12 is secured using the securing means 13 and 13*a*. The lid 32 is secured to container 34 by "snapping the grooves 33 of lid 32 onto the lip 35 of container 34. The apparatus 5 or 30 with the pieces to be cleaned contained within, is placed within a machine such as an automatic dishwasher of any of the well known types. Ordinary, or a special type of detergent is placed in the machine in the conventional manner and the machine is put through a normal wash program or cycle. Upon completion of the wash cycle of the machine, the apparatus 5 or 30 is removed from within the machine, the pieces that have been cleaned may be immediately or later removed from apparatus 5 or 30.

It is thought that the present invention, the method and the apparatus for cleaning jewelry and small parts and many of its attendant advantages is understood from the foregoing description and it will be apparent that various changes may be made in the form, construction and arrangement of the parts thereof without departing from the spirit and scope of the invention or sacrificing all of its material advantages, the form hereinbefore described being merely a preferred or exemplary embodiment thereof.

I claim:

1. A method for cleaning jewelry using a cleaning apparatus, having a main cavity therein and adapted to removably and nondamagingly contain jewelry pieces to be cleaned within said main cavity when said apparatus is placed within an automatic dishwashing machine which provides a quantity of turbulent and a high velocity cleaning fluid, said method comprising the steps of:

placing said jewelry pieces into a main cavity of said cleaning apparatus, each of said jewelry pieces within said main cavity held in a substantially fixed location and position using hooks and posts in a manner which permits said turbulent and high velocity cleaning fluid to impinge onto said jewelry pieces contained within said main cavity;

covering said main cavity of said apparatus using a covering means adapted to permit said turbulent and high velocity cleaning fluid to impinge onto said jewelry pieces contained within said main cavity of said apparatus;

wherein said main cavity and said means for covering are made from at least one of the materials selected from the group consisting of nylon mesh, metallic mesh, plastic mesh, fiberglass mesh, fabric mesh, woven wood and plastic having a plurality of apertures therethrough;

attaching said means for covering to said apparatus; and placing said apparatus within a machine which provides said turbulent and high velocity cleaning fluid and permitting said turbulent and high velocity cleaning fluid to impinge onto said jewelry pieces for a predetermined period of time.

2. The method for cleaning jewelry using a cleaning apparatus and an automatic dishwashing machine according to claim 1 further comprising a plurality of attaching devices onto which various types and sizes of jewelry pieces may be securely and effectively attached and at least one compartment into which various types and sizes of jewelry pieces may be securely and effectively placed, said attaching devices and said at least one compartment adapted to permit the turbulent and high velocity cleaning fluid to impinge onto each of the jewelry pieces contained within said main cavity.

3. The method for cleaning jewelry using a cleaning apparatus and an automatic dishwashing machine according to claim 2 wherein said cleaning fluid is water having an appropriate cleaning detergent contained therein.

4. A jewelry cleaning apparatus adapted to removably and nondamagingly contain jewelry pieces to be cleaned, said jewelry cleaning apparatus comprising: an automatic dishwashing machine which provides a turbulent and high velocity cleaning fluid; a jewelry containing apparatus for placement into said automatic dishwashing machine comprising;

wall means defining a main cavity for containing jewelry pieces therein and said wall means adapted to permit said turbulent and high velocity cleaning fluid to pass therethrough and to impinge onto said jewelry pieces contained within said main cavity, said main cavity having edges defining an access, said access for placing said jewelry pieces into said main cavity;

means for covering said access which means for covering is adapted to permit said turbulent and high velocity cleaning fluid to pass therethrough and to impinge onto said jewelry pieces contained within said cavity; wherein said means defining a main cavity for containing jewelry pieces therein and said means for covering said access are made from at least one of the materials selected from the group consisting of nylon mesh, metallic mesh plastic mesh, fiberglass mesh, fabric mesh, woven wood and plastic having a plurality of apertures therethrough;

means for securely attaching said means for covering to said wall means defining said main cavity; and hooks and posts means for holding in a substantially fixed location and position each of said jewelry pieces within said main cavity in a manner which permits said turbulent and high velocity cleaning fluid to impinge onto said jewelry pieces contained within said main cavity, said jewelry pieces contained within said main cavity being cleaned upon placing said jewelry containing apparatus within said automatic dishwashing machine which provides said turbulent and high velocity cleaning fluid and causing said turbulent and high velocity cleaning fluid to impinge onto said jewelry pieces for a predetermined period of time.

5. The jewelry cleaning apparatus according to claim 4 further comprising a plurality of attaching devices onto which various types and sizes of jewelry pieces may be securely and effectively placed and at least one compartment into which various types and sizes of jewelry pieces may be securely and effectively placed, said attaching devices and said at least one compartment adapted to permit said turbulent and high velocity cleaning fluid to impinge onto each of said jewelry pieces contained within said main cavity.

6. The jewelry cleaning apparatus according to claim 5 wherein said high velocity cleaning fluid is water having an appropriate cleaning detergent contained therein.

* * * * *